United States Patent [19]

Hoover

[11] 4,139,798

[45] Feb. 13, 1979

[54] TEMPERATURE COMPENSATION CIRCUIT FOR IMAGE INTENSIFIERS

[75] Inventor: Alan W. Hoover, Hollins, Va.

[73] Assignee: International Telephone & Telegraph Corp., Nutley, N.J.

[21] Appl. No.: 795,262

[22] Filed: May 9, 1977

Related U.S. Application Data

[63] Continuation of Ser. No. 646,798, Jan. 6, 1976, abandoned.

[51] Int. Cl.[2] ..... H01J 31/26; G05F 1/58

[52] U.S. Cl. ..... 315/10; 323/4; 323/68

[58] Field of Search ..... 307/310; 323/1, 4, 16, 323/19, 22 T, 68, 69; 315/10

[56] References Cited

U.S. PATENT DOCUMENTS

| | | | |
|---|---|---|---|
| 2,764,731 | 9/1956 | Koerner | 323/69 |
| 3,048,718 | 8/1962 | Starzec et al. | 323/22 T |
| 3,303,386 | 2/1967 | Murphy | 307/310 X |

OTHER PUBLICATIONS

Harruff, "Combining a Couple of Thermistors," Electronic Design, vol. 16, No. 3, Feb. 1, 1968, pp. 88–90, 323–369.

*Primary Examiner*—A. D. Pellinen

*Attorney, Agent, or Firm*—John T. O'Halloran; Jeffrey P. Morris

[57] ABSTRACT

A temperature compensation circuit for image intensifier power supplies utilizes at least one temperature responsive element to compensate for changes in both the electronic circuit components and the intensifier gain characteristics. The compensated intensifier gain remains constant over a wide range of operating temperatures.

6 Claims, 8 Drawing Figures

TEMPERATURE COMPENSATION CIRCUIT FOR IMAGE INTENSIFIERS

This is a continuation of application Ser. No. 646,798, filed Jan. 6, 1976, now abandoned.

BACKGROUND OF THE INVENTION

The advent of novel power controlled image intensifier circuits provides excellent light output characteristics to image intensifier tubes. The use of one such circuit is shown in copending application Ser. No. 646,799 filed on Jan. 6, 1976 assigned to the common assignee of the instant invention now U.S. Pat. No. 4,037,132. This circuit employs semiconductor components in a feedback circuit to result in good light output characteristics over widely varying ranges of intensifier input illumination and also describes the electronic sensing of the current changes applied to the microchannel plate of the image intensifier tube.

Semiconductor elements such as transistors and diodes vary inversely in voltage with increasing ambient temperature. The use of microchannel plate electron multipliers requires a controlled variation in voltage with changing ambient temperature due to the physical properties of the materials used in the construction of the microchannel plate. These variations in the intensifier components cause corresponding variations to occur in the overall intensifier gain. The purpose of this invention, therefore, is to provide good temperature compensation to power controlled intensifier circuits in order to result in good intensifier gain characteristics over a wide range of ambient temperatures.

SUMMARY OF THE INVENTION

A negative voltage-temperature element is included within the feedback loop of a power controlled image intensifier circuit to compensate for variations in the electrical characteristics of both the power supply and intensifier components.

One embodiment comprises a thermistor element electrically coupled to the base of the control transistor in the power controlled circuit to provide a temperature varying potential across the base emitter junction of the transistor.

DESCRIPTION OF THE PREFERRED EMBODIMENT

Figure 1:
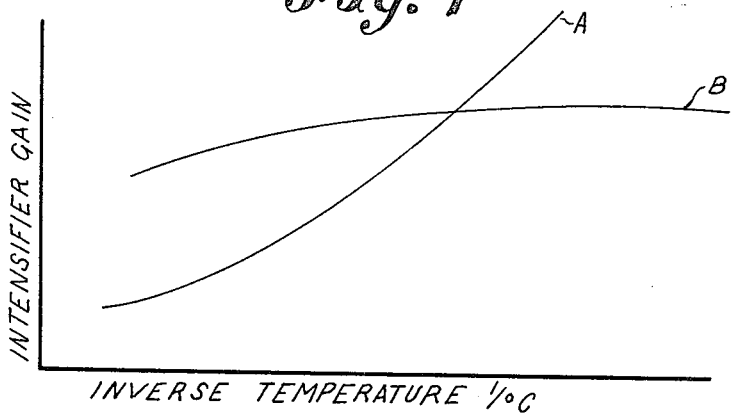
FIG. 1 is a graphic representation of the variation of intensifier gain as a function of ambient temperature.
Figure 2:
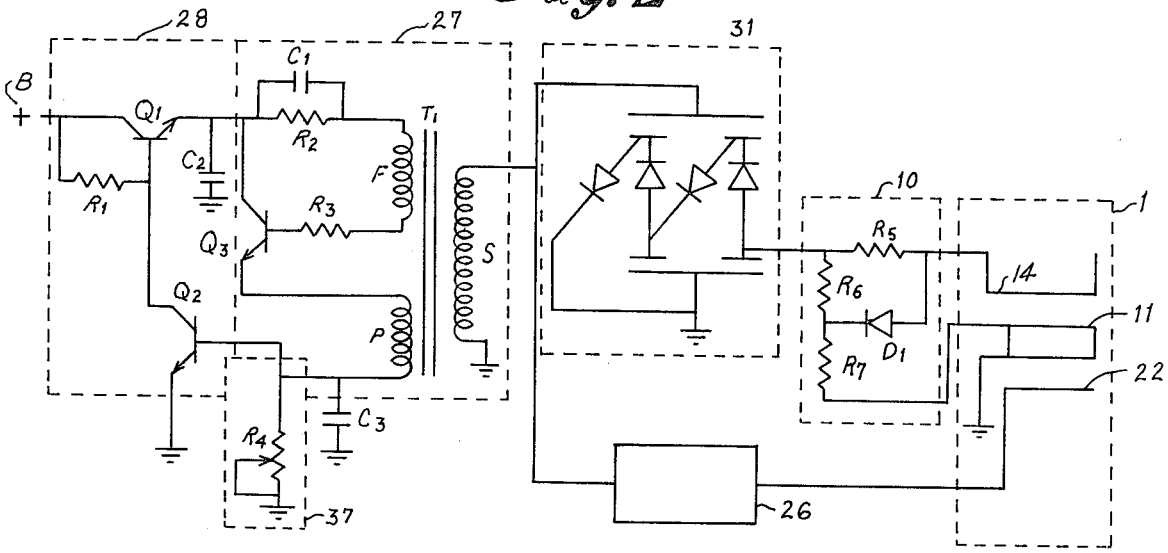
FIG. 2 is a circuit diagram of a power controlled power supply for image intensifiers.

A power controlled image intensifier circuit in accordance with the aforementioned application Ser. No. 646,799 can be seen by reference to FIG. 2 where a power sensing subcircuit includes a resistive element $R_4$ electrically coupled to a pair of power control transistors $Q_1$, $Q_2$. The circuit also includes at least one diode $D_1$ in the voltage clamp 10. As described earlier these semiconductor elements have negative voltage-temperature characteristics, and serve to produce a variation in intensifier gain with changing temperature ambient. The variation of intensifier gain A with temperature in an uncompensated power controlled intensifier can be seen by reference to FIG. 1. The gain rapidly increases upon decreasing ambient temperature so that continuous electrical adjustments must be made to compensate for variations in ambient temperature during intensifier use. A complete description of FIG. 2 may be found in U.S. Pat. No. 4,037,132 which patent is incorporated by reference. In particular FIG. 3 therein corresponds to FIG. 2 of this specification.

Figure 3:
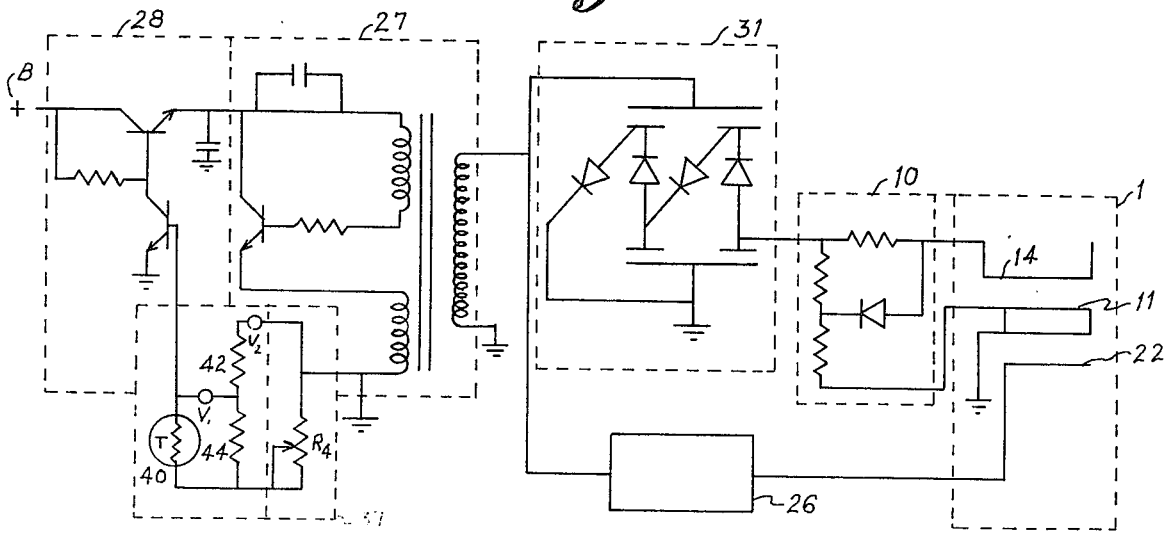
FIG. 3 is a circuit diagram of the power supply of FIG. 2 including one embodiment of the temperature compensation circuit of this invention.

One method for compensating for the variation in ambient temperature can be seen by referring to FIG. 3 where a thermistor element 40 is electrically coupled to the junction between two resistors 42, 44 which in turn are coupled to the current sensing resistor $R_4$. The purpose of the thermistor 40 in combination with the two resistors 42, 44 is to provide a voltage divider where the voltage $V_1$ occurring across the first resistor 44 in parallel with the thermistor 40 and the voltage $V_2$ occurring across both resistors 42, 44 provides a temperature varying potential across the base emitter junction of the transistor $Q_2$ to electrically compensate for temperature variations within the power control circuit and within the image intensifier itself.

Figure 4:
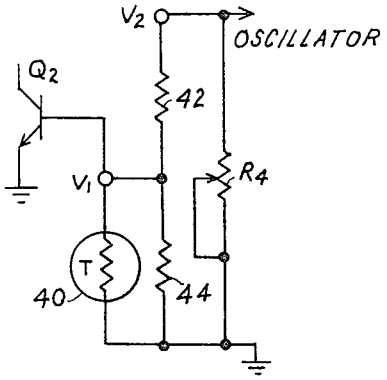
FIG. 4 is a circuit diagram of an alternate embodiment of the temperature compensation circuit of this invention.
Figure 6:
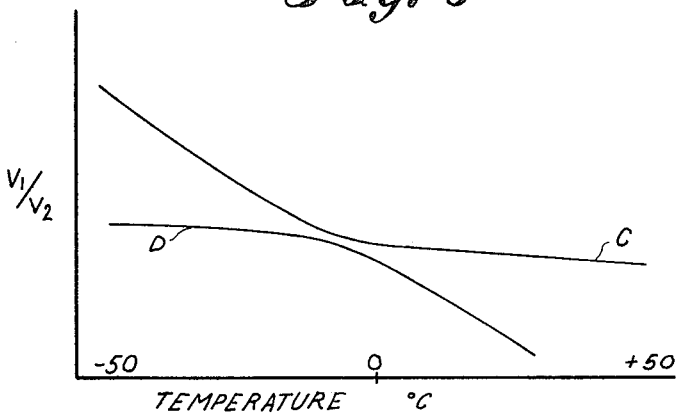
FIG. 6 is a graphic representation of the variation in voltage ratios for the embodiments of FIGS. 4 and 5 as a function of ambient temperature.

FIG. 6 shows the variation D between the ratio of $V_1$ to $V_2$ as a function of ambient temperature for the circuit embodiment of FIG. 4. The variation in the ratio of $V_1$ to $V_2$ for the parallel combination of thermistor 40 and resistor 44 is shown at curve D. The inclusion of the parallel thermistor 40 and resistor 44 provides good temperature compensation within the range of between 0° and +50° C. For temperatures less than 0° C. in the embodiment of the parallel thermistor 40, resistor 44 arrangement are ineffective for providing temperature compensation. This is shown by the horizontal portion of curve D in the range of 0° to −50° C. For good temperature compensation properties the plot of the ratio of $V_1$ to $V_2$ should have a non-linear decreasing slope with increasing temperature over the range of −50° C. to +50° C.

Figure 5:
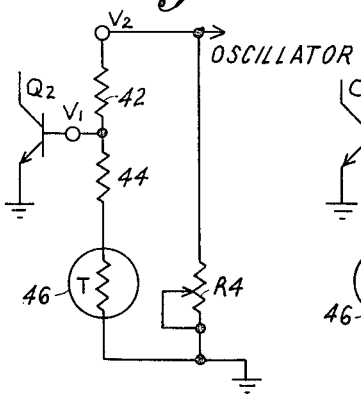
FIG. 5 is a further embodiment of the temperature compensation circuit of this invention.

A further embodiment of the temperature compensating circuit of this invention can be seen by referring to FIG. 5 where the temperature compensating elements are shown in some detail. In this embodiment the series thermistor 46 is electrically coupled in series with both resistors 42, 44 and the voltage $V_1$ appears across the combination of resistor 44 and thermistor 46; and the voltage $V_2$ is the sum of the voltages appearing across resistor 42, resistor 44 and thermistor 46. The effect of the ratio of $V_1$ to $V_2$ with increasing temperature for this embodiment can be seen by referring to FIG. 6. Curve C denotes the variation of the ratio of $V_1$ to $V_2$ to be linear over the range of 0° to −50° C. Curve C shows a horizontal portion over the range from 0° to +50° C. indicating that there is no effective temperature compensation above 0° C. with this embodiment.

Figure 7:
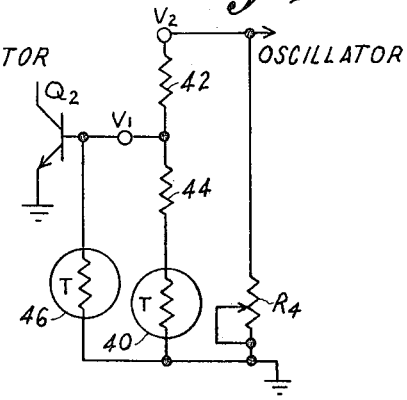
FIG. 7 is a further embodiment of the temperature compensation circuit of this invention.
Figure 8:
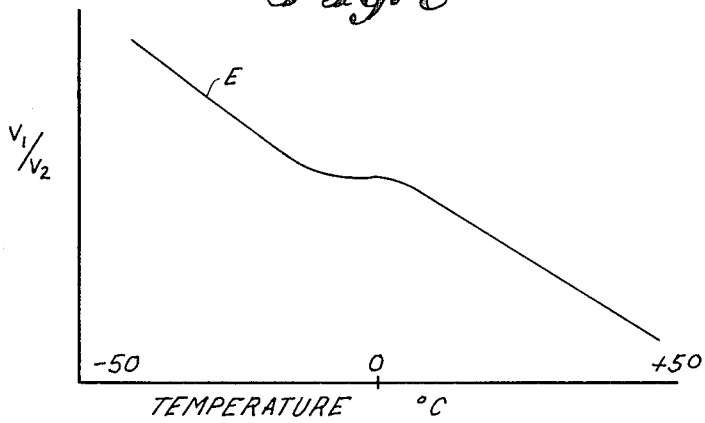
FIG. 8 is a schematic representation of the voltage ratios for the embodiment of FIG. 7 as a function of ambient temperature.

FIG. 7 shows a further embodiment of the temperature compensation circuit of this invention where two thermistors 40, 46 are combined in a series parallel arrangement with resistors 42 and 44. The good temperature compensation properties for the embodiment of the circuit of FIG. 4 for the higher ambient temperatures is combined with the low temperature compensation properties for the series combination shown in the embodiment of FIG. 5 to provide good overall temperature compensation over the entire range from −50° to +50° C. The variation E in the ratio of $V_1$ to $V_2$ over the temperature range from −50° to +50° C. for this embodiment is shown in FIG. 8.

The variation in the ratio between voltages $V_1$ and $V_2$ is a good indication of the temperature compensation properties for the circuit of this invention. The resulting variation B of image intensifier gain over the same temperature range can be seen by referring to FIG. 1.

Curve B shows the intensifier gain over the range of ambient temperature for an image intensifier having the temperature compensation circuit depicted in the embodiment of FIG. 7. In this embodiment the intensifier gain is shown relatively constant over a wide range of ambient temperatures, and substantially improves over the variations in intensifier gain for the prior art non-compensated intensifier gain A.

Although thermistors are used within the temperature compensation circuits of this invention it is understood that other devices having negative voltage temperature characteristics can also be employed.

Other power controlled circuits are depicted in the aforementioned U.S. application which utilizes the power detection circuit in various locations within the power supply. The temperature compensation circuits of this invention readily find application when electrically coupled within the power sensing circuits for all the embodiments of the aforementioned application.

What is claimed is:

1. In an image intensifier power supply for providing power to an image intensifier having a microchannel plate, a compensation circuit comprising:

power control transistor regulator means for regulating input power to said image intensifier, including means for sensing the current applied to said microchannel plate and means for varying the voltage applied to said microchannel plate in accordance with a first non-linear compensation voltage in response to said sensed current;

voltage divider means for deriving a second non-linear compensation voltage to compensate for non-linear variation in microchannel plate light gain with temperature variations in said microchannel plate, said voltage divider means including at least one negative voltage-temperature element for varying said second compensation voltage in response to temperature variations; and means for transformer coupling said input power to said image intensifier after regulation by said first and second compensation voltage.

2. The circuit of claim 1 wherein said voltage divider means comprises first and second resistors coupled to said negative voltage-temperature element, for deriving said second compensation voltage, said second compensation voltage being applied to the base of said power control transistor regulator means.

3. The circuit of claim 2 wherein said negative voltage-temperature element is electrically connected in parallel with one of said resistors.

4. The circuit of claim 3 wherein said negative voltage-temperature element comprises at least one thermistor.

5. The circuit of claim 3 further including a second negative voltage-temperature element in series with said second resistor.

6. The circuit of claim 2 wherein said negative voltage-temperature element is in series with said first and second resistors.

* * * * *